US006085381A

United States Patent [19]

Aleshire

[11] Patent Number: 6,085,381

[45] Date of Patent: Jul. 11, 2000

[54] LIQUID REMOVER FROM CIRCULAR CONTAINER

[76] Inventor: Arthur E. Aleshire, 36 E. Lincoln Ave., Columbus, Ohio 43214

[21] Appl. No.: 09/164,640

[22] Filed: Oct. 1, 1998

[51] Int. Cl.[7] ..... A47L 13/11; A47L 17/06

[52] U.S. Cl. ..... 15/245

[58] Field of Search ..... 15/121, 236.01, 15/236.07, 245

[56] References Cited

U.S. PATENT DOCUMENTS

| | | | |
|---|---|---|---|
| 353,863 | 12/1886 | Kaelin | 15/245 |
| 509,875 | 12/1893 | Campbell | 15/245 |
| 1,497,933 | 6/1924 | Oberti | 15/245 |
| 1,789,636 | 1/1931 | Oberti | 15/245 |
| 2,904,807 | 9/1959 | Obergfell | 15/245 |
| 3,091,790 | 6/1963 | Schroeder | 15/245 |
| 4,103,383 | 8/1978 | Martin | 15/245 |
| 5,349,716 | 9/1994 | Millar | 15/245 |
| 5,464,481 | 11/1995 | Lietz, Jr. | 15/245 |

FOREIGN PATENT DOCUMENTS

| | | | |
|---|---|---|---|
| 974350 | 9/1950 | France | 15/245 |
| 609609 | 9/1960 | Italy | 15/245 |

*Primary Examiner*—Randall E. Chin

[57] ABSTRACT

A liquid remover from circular containers including a frame with a handle at its inboard end and a support at its outboard end and with an elongated connector therebetween. The connector and handle have a common axis. The support is located in a plane perpendicular to the axis of the connector and handle with a radius of curvature between about 6.0 and 7.0 inches, preferably about 6.5 inches and with a housing and a slot formed in the interior face along the length of the support and facing its center of curvature.

12 Claims, 3 Drawing Sheets

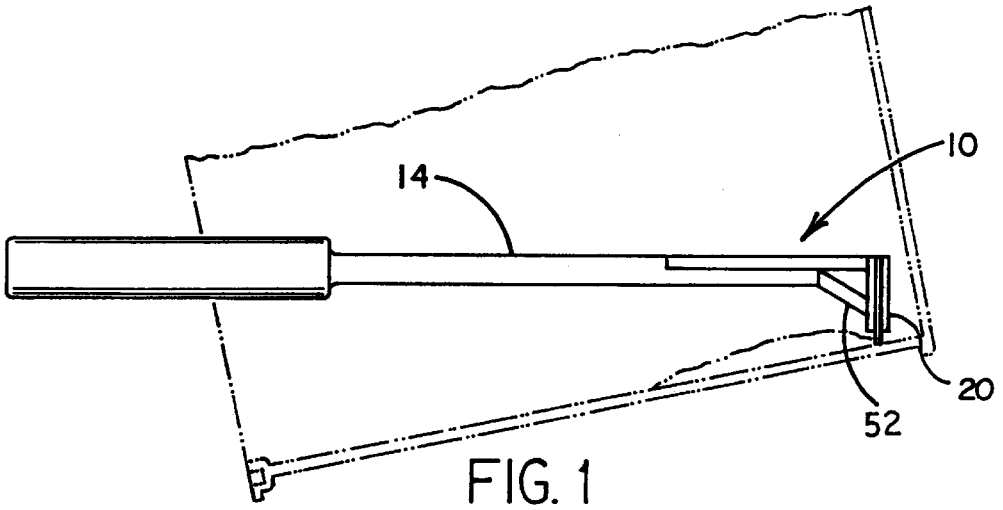
FIG. 1
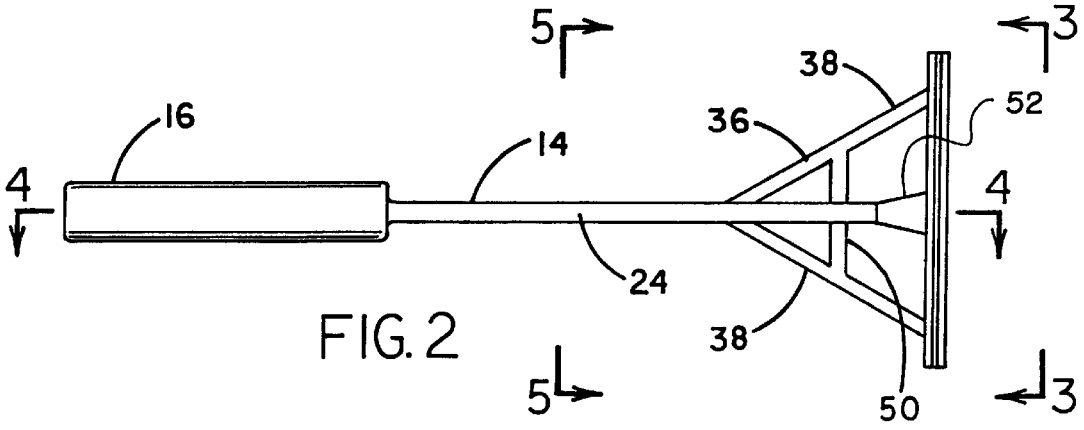
FIG. 2
FIG. 3
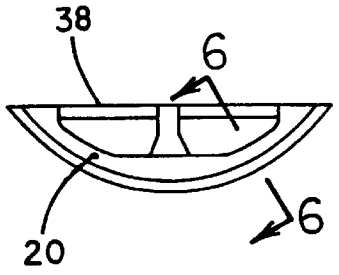

LIQUID REMOVER FROM CIRCULAR CONTAINER

BACKGROUND OF THE INVENTION

1. Field of the Invention

The present invention relates to a liquid remover from circular containers and more particularly pertains to scraping the container residue from a container.

2. Description of the Prior Art

The use of liquid container cleaners of known designs and configurations is known in the prior art. More specifically, container cleaners of known designs and configurations heretofore devised and utilized for the purpose of cleaning containers by known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,324,018 to Olsson discloses a Paint Equipment Cleaning Tool. U.S. Pat. No. 4,132,502 to Bunke discloses a Spatula for Mixing Plastic Substances. U.S. Pat. No. Des. 344,380 to Hippler discloses a Paint Stirrer. U.S. Pat. No. 4,553,279 to Gassew et al. discloses a Multi-purpose Paint Stick. U.S. Pat. No. 4,907,714 to Gatz discloses a Resilient Paint Can Accessory. Lastly, U.S. Pat. No. 4,982,471 to Bannan discloses a Multi-Use Paint Tool.

In this respect, the liquid remover from circular containers according to the present invention substantially departs from the conventional concepts and designs of the prior art, and in doing so provides an apparatus primarily developed for the purpose of scraping the liquid residue from a container.

Therefore, it can be appreciated that there exists a continuing need for a new and improved liquid remover from circular containers which can be used for scraping the residue from a circular containers. In this regard, the present invention substantially fulfills this need.

SUMMARY OF THE INVENTION

In view of the foregoing disadvantages inherent in the known types of container cleaners of known designs and configurations now present in the prior art, the present invention provides an improved liquid remover from circular containers. As such, the general purpose of the present invention, which will be described subsequently in greater detail, is to provide a new and improved liquid remover from circular containers and method which has all the advantages of the prior art and none of the disadvantages.

To attain this, the present invention essentially comprises a new and improved liquid remover from circular containers for scraping the liquid residue from a container comprising, in combination a frame which is fabricated of an essentially rigid plastic material with an enlarged cylindrical handle at its inboard end. It also has a support at its outboard end and an elongated connector therebetween. The connector and handle are between about 10 and 12 inches, preferably about 11 inches in length. The connector and handle have a common axis. The support is in an arcuate configuration and being between about 3 and 5 inches in length, preferably about 4 inches in length. The arcuate support is located in a plane perpendicular to the axis of the connector and handle with a radius of curvature between about 6.0 and 7.0 inches, preferably about 6.5 inches and with a rectangular housing and a slot formed in the interior face along the length of the support and facing its center of curvature. An A-shaped brace with diagonal legs couples the ends of the support with the connector at a central extent thereof and with a cross-leg coupling the connector with central extents of the diagonal legs. An elastomeric squeegee insert is provided insert of a length essentially equal to the length of the support with an enlarged rectangular interior end removably received within the housing and extending through the slot with a free exterior end adapted to be slid with respect to the interior of the paint can for cleaning the can through a scraping motion.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved liquid remover from circular containers which has all of the advantages of the prior art can cleaners of known designs and configurations and none of the disadvantages.

It is another object of the present invention to provide a new and imp roved liquid remover from circular containers which may be easily and efficiently manufactured and marketed.

It is further object of the present invention to provide a new and improved liquid remover from circular containers, which is of durable and reliable constructions.

An even further object of the present invention is to provide a new and improved liquid remover from circular containers which is susceptible of a low cost of manufacture with regard to both materials and labor, and which accordingly is then susceptible of low prices of sale to the consuming public, thereby making such paint container cleaning system economically available to the buying public.

Even still another object of the present invention is to provide a liquid remover from circular containers for scraping the residue, such as paint, from a can.

Lastly, it is an object of the present invention to provide a new and improved liquid remover from circular containers, which includes a frame with a handle at its inboard end and a support at its outboard end and with an elongated connector therebetween. The connector and handle have a common axis. The support is located in a plane perpendicular to the axis of the connector and handle with a radius of curvature between about 6.0 and 7.0 inches, preferably about 6.5 inches and with a housing and a slot formed in the interior face along the length of the support and facing its center of curvature.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of the preferred embodiment of the liquid remover from circular containers constructed in accordance with the principles of the present invention.

FIG. 2 is a bottom elevational view of the device shown in FIG. 1.

FIG. 3 is an end elevational view taken along line 3—3 of FIG. 2.

The same reference numerals refer to the same parts through the various Figures.

DESCRIPTION OF THE PREFERRED EMBODIMENT

Figure 4:
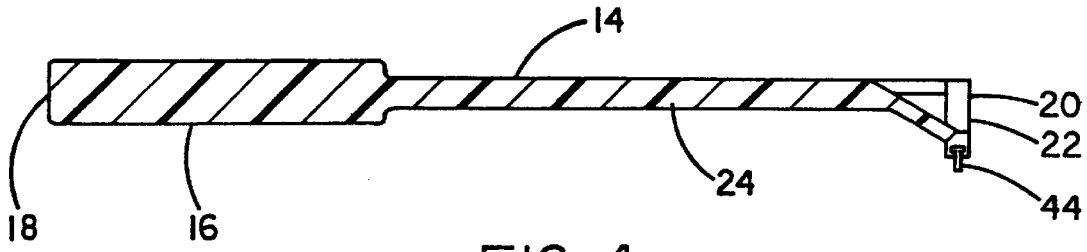
FIG. 4 is a cross-sectional view taken along line 4—4 of FIG. 2.
Figure 5:
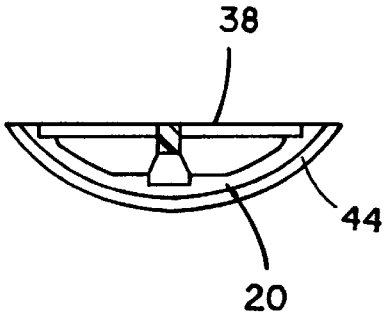
FIG. 5 is a cross-sectional view taken along line 5—5 of FIG. 2.
Figure 6:
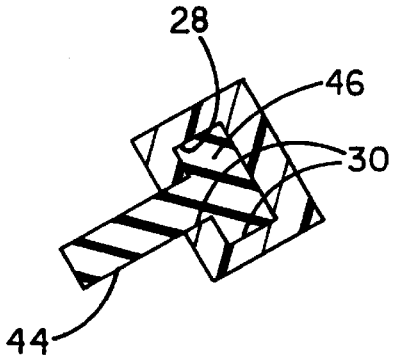
FIG. 6 is a cross-sectional view taken along line 6—6 of FIG. 3.
Figure 7:
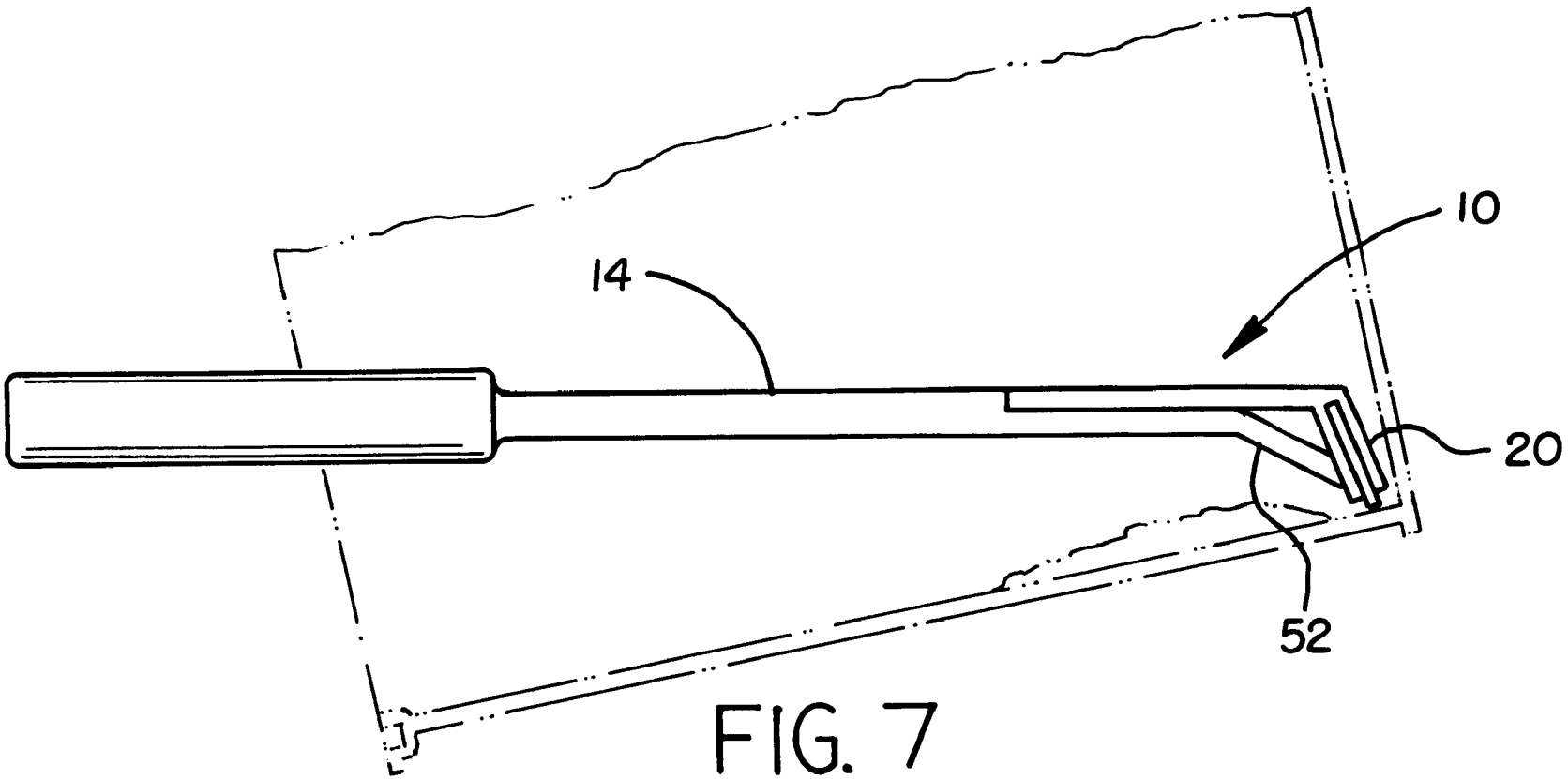
FIG. 7 is a side view of an alternate embodiment of the present invention.

With reference now to the drawings, and in particular to FIGS. 1 through 7 thereof, the preferred embodiment of the new and improved liquid remover from circular containers embodying the principles and concepts of the present invention and generally designated by the reference numeral 10 will be described.

The present invention, the liquid remover from circular containers 10 is comprised of a plurality of components. Such components are individually configured and correlated with respect to each other so as to attain the desired objective.

More specifically, the new and improved liquid remover from circular containers 10 for scraping the liquid residue from a container comprises a frame 14 fabricated of an essentially rigid plastic or stainless steel material with an enlarged cylindrical handle 16 at its inboard end 18. It also has an arcuate coupling portion 52 at its outboard end 22 and with an elongated connector 24 therebetween. The connector and handle are between about 10 and 12 inches, preferably about 11 inches in length. The connector and handle have a common axis.

A support 20 is coupled to the coupling portion 52 of the frame and is in an arcuate configuration and is between about 3 and 5 inches in length, preferably about 4 inches in length. The arcuate support is located in a plane perpendicular to the axis of the connector and handle with a radius of curvature between about 6.0 and 7.0 inches, preferably about 6.5 inches and with a rectangular housing 28 and a slot 30 formed in the interior face along the length of the support and facing its center of curvature.

Preferably , an A-shaped brace 36 with diagonal legs 38 couples the ends of the support with the connector at a central extent thereof and with a cross-leg 50 coupling the connector with central extents of the diagonal legs. The coupling portion 52 of the connector of the frame lies at an angle with respect to a plane extending between an end of the diagonal legs of the A-shaped brace 36 opposite the connector 24.

An elastomeric squeegee insert 44 is provided and has a length essentially equal to the length of the radius of curvature of the support with an enlarged rectangular interior end 46 removably received within the housing 28 and extending through the slot 30 with a free exterior end adapted to be slid with respect to the interior of the circular container for cleaning the container through a scraping motion.

Alternatively, the radius of curvature of the arcuate support is located in a plane at an angle of between about 15 and 45 degrees, preferably about 35 degrees, from a plane extending across the diagonal legs 38 of the brace 36 and the axis of the connector and handle.

In an alternate embodiment, for use with smaller containers, the connector and handle of the frame are between about 4 and 12, preferably about 8 inches, in length. The support is between about 1 and 3 inches in length, preferably about 2 inches in length. The radius of curvature of the support is between about 3 and 4 inches, preferably about 3.5 inches.

As described hereinabove, the system of the present invention is a relatively small plastic assembly with a squeegee attached which is used for scraping the sides and bottom of a liquid container that is nearly empty. An individual is able to remove the majority of liquid still remaining on the inside of a container after the bulk of the liquid has either been used or poured into another container.

In use, with the circular container tilted slightly beyond a horizontal position, an individual inserts the liquid container cleaner into the container, sponges off the bottom of the container with a circular motion, then pulls the assembly down the sides. The edge of the squeegee, along with the edge of the plastic would be able to force most of the remaining liquid to flow out of the container.

The appealing features of the liquid remover of the present invention are its ease of use, lightweight, timesaving, reasonable price, and its ability to easily clean the sides and bottom of a used liquid container.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A liquid remover from circular containers for scraping the liquid residue from a container comprising, in combination:

a frame fabricated of an essentially rigid plastic material with an enlarged cylindrical handle at its inboard end and a coupling portion at its outboard end and with an elongated connector therebetween, the connector and handle being between about 10 and 12 inches in length, the connector and handle having a common axis;

a support being coupled to the coupling portion of the frame, the support being in an arcuate configuration and being between about 3 and 5 inches in length, the arcuate support being located in a plane perpendicular to the axis of the connector and handle with a radius of curvature between about 6.0 and 7.0 inches and with a rectangular housing and a slot formed in an interior face along the length of the support and facing its center of curvature;

an A-shaped brace with diagonal legs coupling the ends of the support with the connector at a central extent thereof and with a cross-leg coupling the connector with central extents of the diagonal legs; and an elastomeric squeegee insert of a length essentially equal to the length of the radius of curvature of the support with an enlarged rectangular interior end removably received within the housing and extending through the slot with a free exterior end adapted to be slid with respect to the interior of the container for cleaning the container through a scraping motion.

2. The liquid remover as set forth in claim 1, wherein the connector and handle of the frame are about 11 inches in length.

3. The liquid remover as set forth in claim 1, wherein the support is about 4 inches in length.

4. The liquid remover as set forth in claim 1, wherein the radius of curvature of the support is about 6.5 inches.

5. A liquid remover front circular containers comprising:

a frame with an enlarged cylindrical handle at its inboard end and a coupling portion at its outboard end and with an elongated connector therebetween, the connector and handle having a common axis;

a support being coupled to the coupling portion of the frame, the support being located in a plane perpendicular to the axis of the connector and handle with a radius of curvature and with a housing and a slot formed in an interior face along the length of the support and facing its center of curvature; and an elastomeric squeegee insert with an enlarged rectangular interior end removably received within the housing and extending through the slot with a free exterior end adapted to be slid with respect to the interior of the container for cleaning the container through a scraping motion.

6. The liquid remover as set forth in claim 5 and further comprising an A-shaped brace with legs coupling the ends of the support with the connector at a central extent thereof and with a cross-leg coupling the connector with central extents of the diagonal legs.

7. The liquid remover as set forth in claim 6, wherein the coupling portion of the connector of the frame lies at an angle with respect to a plane extending between an end of the diagonal legs of the A-shaped brace opposite the connector.

8. A liquid remover from circular containers for scraping the liquid residue from a container comprising, in combination:

a frame fabricated of an essentially rigid plastic material with an enlarged cylindrical handle at its inboard end and a coupling portion at its outboard end and with an elongated connector therebetween, the connector and handle being between about 4 and 12 inches in length, the connector and handle having a common axis;

a support being coupled to the coupling portion of the frame, the support being in an arcuate configuration and being between about 1 and 3 inches in length, the arcuate support having a radius of curvature between about 3.0 and 4.0 inches and with a rectangular housing and a slot formed in an interior face along the length of the support and facing its center of curvature;

an A-shaped brace with diagonal legs coupling the ends of the support with the connector at a central extent thereof and with a cross-leg coupling the connector with central extents of the diagonal legs;

an elastomeric squeegee insert of a length essentially equal to the length of the radius of curvature of the support with an enlarged rectangular interior end removably received within the housing and extending through the slot with a free exterior end adapted to be slid with respect to the interior of the container for cleaning the container through a scraping motion;

wherein the radius of curvature of the arcuate support is located in a plane at an angle of between about 15 and 45 degrees from a plane extending across the diagonal legs of the brace and the axis of the connector and handle; and wherein the coupling portion of the connector of the frame lies at an angle with respect to a plane extending between an end of the diagonal legs of the A-shaped brace opposite the connector.

9. The liquid remover as set forth in claim 8, wherein the connector and handle of the frame are about 8 inches in length.

10. The liquid remover as set forth in claim 8, wherein the support is about 2 inches in length.

11. The liquid remover as set forth in claim 8, wherein the radius of curvature of the support is about 3.5 inches.

12. The liquid remover as set forth in claim 11, wherein the radius of curvature of the arcuate support is located in a plane at an angle of about 35 degrees from the plane extending across the diagonal legs of the brace and the axis of the connector and handle.

* * * * *